US009938992B1

(12) United States Patent
Scotti

(10) Patent No.: US 9,938,992 B1
(45) Date of Patent: Apr. 10, 2018

(54) MITIGATING HYDRAULIC GRADIENTS BY ASSISTING GAS DISPLACEMENT PUMPS WITH INVERTED HYDROSTATIC STANDPIPES

(71) Applicant: Anthony Michael Scotti, Deerfield Beach, FL (US)

(72) Inventor: Anthony Michael Scotti, Deerfield Beach, FL (US)

( * ) Notice: Subject to any disclaimer, the term of this patent is extended or adjusted under 35 U.S.C. 154(b) by 51 days.

(21) Appl. No.: 15/071,838

(22) Filed: Mar. 16, 2016

(51) Int. Cl.

| | |
|---|---|
| ***F04F 5/46*** | (2006.01) |
| ***F04F 5/24*** | (2006.01) |
| ***F04F 10/02*** | (2006.01) |
| ***F03B 11/00*** | (2006.01) |
| ***F03B 11/02*** | (2006.01) |
| *F03B 17/04* | (2006.01) |

(52) U.S. Cl.
CPC ..... *F04F 5/24* (2013.01); *F03B 11/004* (2013.01); *F03B 11/02* (2013.01); *F04F 10/02* (2013.01); *F03B 17/04* (2013.01); *Y10S 415/916* (2013.01)

(58) Field of Classification Search
CPC ... F04F 5/24; F04F 10/02; F03B 11/02; F03B 11/004; F03B 17/04; Y10S 415/916
See application file for complete search history.

(56) References Cited

U.S. PATENT DOCUMENTS 3,129,162 A * 4/1964 Jones ..... C02F 1/686 204/278
3,590,761 A * 7/1971 Parkes ..... B63G 8/22 114/257
4,234,349 A * 11/1980 Suzor ..... B01F 3/0446 127/12
4,293,506 A * 10/1981 Lipert ..... B01F 13/0244 137/209
4,297,081 A * 10/1981 Irvin ..... G01F 23/167 417/2
4,380,933 A * 4/1983 Irvin ..... G01F 23/167 73/298
4,678,040 A * 7/1987 McLaughlin ..... B09C 1/002 166/370
5,312,232 A * 5/1994 Horton ..... F04F 1/18 417/108
5,622,458 A * 4/1997 Ward ..... B01D 24/26 406/108
5,777,214 A * 7/1998 Thompson ..... G01N 1/34 73/19.12
6,272,839 B1 * 8/2001 Karl ..... F02C 3/00 60/783
6,668,943 B1 * 12/2003 Maus ..... E21B 21/001 175/212
8,047,808 B2 * 11/2011 Kondo ..... F04F 1/18 417/108

(Continued)

*Primary Examiner* — Michael C Zarroli
(74) *Attorney, Agent, or Firm* — Westerman, Hattori, Danials, Adrian, LLP

(57) ABSTRACT

The invention is a fluid handling process whereby a submerged pulsating low-pressure gas displacement pump is assisted by an inverted hydrostatic standpipe for the purpose of transporting ambient pressure liquid and gas. An apparatus with no moving parts pumps and transports gas and liquid at near-ambient pressure as a mixed medium by means of subtle design-induced pressure differentials within the inverted hydrostatic standpipe, siphon, pump chamber and riser, enabling conveyance over extended distances and inclined planes.

20 Claims, 4 Drawing Sheets

Compressed Gas Configuration – cross section

1 Reservoir 2 Inverted hydrostatic standpipe

Figure 1:
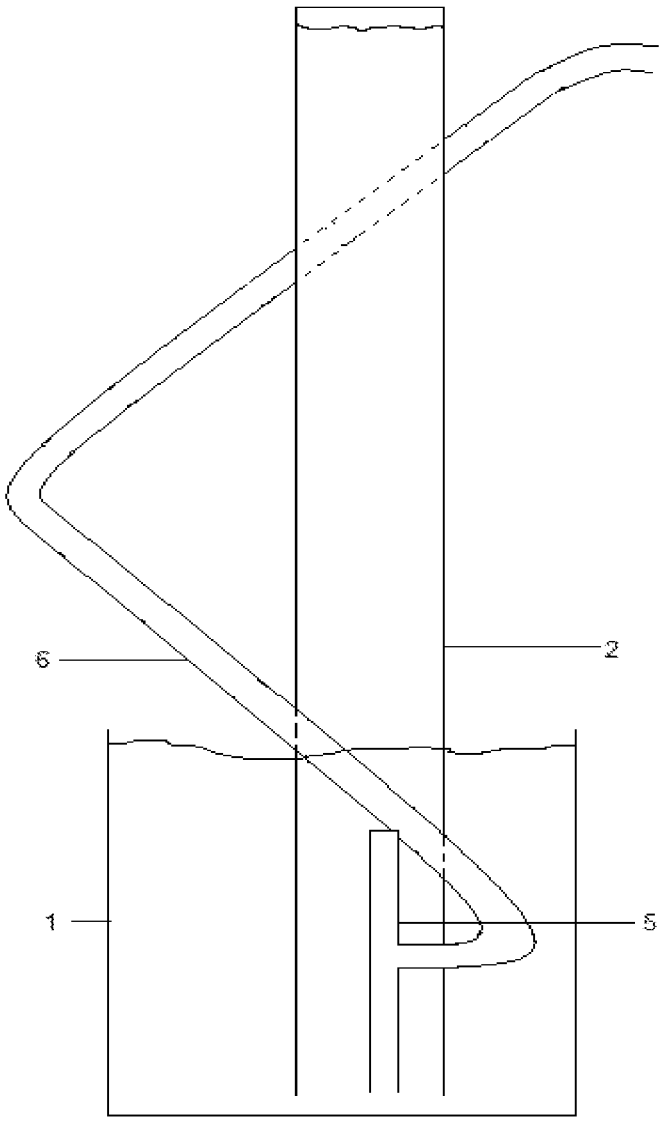

3 Solar powered compressor 4 Gas inlet

5 Pump chamber 6 Riser

(56) References Cited

U.S. PATENT DOCUMENTS

| | | | | |
|---|---|---|---|---|
| 9,561,975 | B2 * | 2/2017 | Stone | A01K 63/042 |
| 2012/0090339 | A1 * | 4/2012 | Ohlsson | F04F 1/18<br>62/119 |
| 2014/0193724 | A1 * | 7/2014 | Daniel | H01M 8/04276<br>429/408 |

* cited by examiner

The Subtle Energy Pump in situ – cross section

1 Reservoir 2 Inverted hydrostatic standpipe

5 Pump chamber 6 Riser

The Subtle Energy Pump – exploded view

2 Inverted hydrostatic standpipe

5 Pump chamber 6 Riser

Compressed Gas Configuration – cross section

1 Reservoir 2 Inverted hydrostatic standpipe

3 Solar powered compressor 4 Gas inlet

5 Pump chamber 6 Riser

Ambient pressure gas configuration – cross section

1 Reservoir 2 Inverted hydrostatic standpipe

5 Pump chamber 6 Riser 7 Primary reservoir

8 Siphon 9 Venturi 10 Adjustable valve

MITIGATING HYDRAULIC GRADIENTS BY ASSISTING GAS DISPLACEMENT PUMPS WITH INVERTED HYDROSTATIC STANDPIPES

BACKGROUND

Field of Invention

The submitted invention relates to fluid handling.

There is a global need for alternative power technologies that are inexpensive to maintain and efficient in operation. While world energy consumption increased at an alarming rate, the fast depletion of our fossil fuels (petroleum, gas and coal) and their pollution of our ecosystem prompted academia, the private sector and governments to find environmentally friendly alternative energy sources. The studies begun in the 1970's identified solar, wind, biomass, ocean waves and currents as the most promising candidates. Yet as wind power turbines grow at a rate of 20% world-wide and solar technologies advance, the total electric generation from these sources, excluding hydroelectricity, is still less than 3% of world consumption today.

Although the global potential of solar and wind is much higher than world power consumption, harvesting useful energy from these sources in a consistent manner is very challenging. For example, in general the power generation from a wind farm dies off during the daytime, especially during the afternoon hours when electricity is needed most. Conversely, it picks up or reaches its maximum during night hours when electricity is needed the least. Similarly, solar or wave based technologies are not predictable either. Required technologies for wind and solar farms are well developed and have come down in price with multiple utility scale power plants in operation, but for all these improvements the insufficiency remains that these sources are not predictable. Battery storage based technologies are still in the developmental stage and are expensive, factoring in their short discharge capabilities and responsible disposal after serviceable life.

Devices that harness these natural forces are geographically limited, technological, relatively complicated and require large capital investments. They have moving parts therefore consume a part of the energy produced and require repairs and maintenance. A more efficient process and device such as the one submitted would be inexpensive, maintenance—free, have no moving parts and be capable of producing usable work at all times anywhere.

Our largest natural clean-energy resource is atmospheric pressure, which is always available for work. This submitted process is a clean-energy derivation of a limitless natural resource and manifests a new paradigm relating to conservation of energy, having applications in innumerable fields.

Gas and liquid both move as fluids—but in opposition at close proximity. Standpipes (hydrostatic columns) and siphons are traditional hydrodynamic devices still used today in the supply and regulation of water systems, but these systems are limited by hydraulic gradients and as such always deliver the water at a lower elevation than it started from. The Cornelius Aqueduct built by the Romans in the $2^{nd}$ century across the Barratina Valley is an example of the clever use of a portion of the potential and kinetic energy possessed by these devices to overcome an extreme obstacle. To service the city of Termini Imerse in Sicily, a double inverted mixed siphon was chosen to cross a deep, broad valley that was divided by a stony ridge 15 meters higher than the elevation of the aqueducts source (Barratina Tower). A mid-point header tank was placed on the ridgetop above the hydraulic gradient to minimize supply oscillations that would result in overflow conditions at the open mid-point tank as well as for removing air from the siphon system and to insure aqueduct flow during low-flow periods.

In nature we see the process of water transport in trees. This natural model is a closer likeness to the invention submitted. The xylem is an inverted hydrostatic column 2, the pump chamber 5 exhaust port is the drawing force of leaf transpiration and ambient gas pressure like the venturi 9 on the root system is the energy applied to transition the metastable water in the roots to the top of the tree via the riser 6.

Similar to the Romans in the Barratina Valley but more like trees, the invention submitted juxtaposes the full potential and kinetic energies of atmospheric pressure, an inverted hydrostatic column and a siphon to induce a continuous cycle that has a net energy output. (See FIG. 4)

Successful exploitation of atmospheric pressure requires critical energy conservation. The submitted process and apparatus with no moving parts manifests usable work from potential and kinetic energy, e.g. the transport of gas and liquid over extended distances and inclined planes.

A process induced by a premeditated derivation of potential and kinetic energies intrinsic to standpipe), for the purpose of propagating a continuous cycle that has a net energy output as ambient pressure gas and less-than-ambient pressure liquid (a siphon and/or an inverted hydrostatic demonstrated by the preferred embodiment, an inexpensive apparatus for transporting liquid and gas by means of subtle design-induced pressure differentials. Hereinafter referred to as 'The Subtle Energy Pump', the core apparatus (See FIG. 2) consists of a riser 6 and a submerged pump chamber 5 with no moving parts, enveloped by an inverted hydrostatic standpipe 2 for the purpose of elevating the reservoir 1 surface within the volume of the standpipe (See FIG. 1) to an elevation where the hydraulic gradient to the delivery site is mitigated.

At this elevation all water within the standpipe (where the pump chamber is located) is metastable, requiring minimal energy (ambient gas pressure) to transition to the delivery elevation via the riser 6. The inverted hydrostatic standpipe 2 is a fulcrum for the exploitation of atmospheric pressure to do usable work 24 hours a day.

DESCRIPTION OF THE ILLUSTRATIONS

The preferred embodiment of the process is illustrated in four drawings; one in situ, one exploded view and two configurations showing two of many available clean-energy gas supplies available for the operation of the apparatus. The numbered elements of the preferred embodiment are as follows:

1. Reservoir—The liquid reservoir is one energy source for the pump by means of the atmospheric pressure exerted on the reservoir surface (gravitational potential energy). A desirable reservoir level must be maintained in relation to the pump. Atmospheric pressure on the reservoir surface effects;

a. Liquid column displacement in the submerged pump chamber b. Transient hydraulic surge c. Intermittent suspension of gas bubbles and liquid in the riser (See FIG. 3 & FIG. 4)

2. Inverted Hydrostatic Standpipe—Traditional use of inverted hydrostatic standpipes is for generating a static low pressure environment. The inverted hydrostatic standpipe is a hollow tube, sealed on the top end, filled with liquid and open in fluid communication with the reservoir 1 on the bottom end. The inverted hydrostatic standpipe is a second energy source for the pump by means of the raised reservoir level present in the standpipe (potential energy) and its ability to promote the pumping and transport of the gas and liquid medium. This simple but critical component raises the reservoir surface within its volume (See FIG. 1) to the elevation desired for gas and liquid delivery, mitigating the hydraulic gradient to the delivery site.

Without the enhancement of the inverted hydrostatic standpipe environ, ambient gas pressure at sea level will only pump liquid 3" above the reservoir surface. Even with the connection of a properly sized riser 6 to the pump chamber 5 exhaust port, the liquid and gas can only be coaxed 12" above the reservoir surface.

The height of the inverted hydrostatic standpipe is equivalent to the elevation desired for liquid and gas delivery at the terminus of the riser 6. Higher delivery elevations necessitate a taller inverted hydrostatic standpipe.

The inverted hydrostatic standpipe has a tolerance fit aperture on its submerged section to receive the pump chamber 5 exhaust port during assembly.

3. Solar Powered Air Compressor (compressed gas configuration only—See FIG. 3)

One of many free-energy methods for utilizing ambient gas pressure, a solar powered pond bubbler was used for the compressed gas prototype.

4. Gas Inlet (compressed gas configuration only—See FIG. 3)—Gas is a third energy source for the pump by virtue of its buoyancy (Archimedes' Principle=kinetic energy). In the compressed gas configuration, gas is directed to the pump chamber 5 via the gas inlet. (See FIG. 3). The gas inlet is a hollow tube open on both ends and in fluid connection with a solar powered compressor 3 on one end and in fluid communication with the pump chamber 5 and reservoir 1 at its terminus.

5. Pump Chamber—The pump chamber is a hollow vertical tube, sealed on the top end and in fluid communication with both the inverted hydrostatic standpipe 2 and the reservoir 1 on the bottom end; the pump chamber exhaust port emerges in a horizontal attitude from the pump chamber and may be of equal diameter and is in fluid connection with the riser 6. The pump chamber is enveloped by the inverted hydrostatic standpipe 2 and a tolerance fit aperture on the submerged portion of the inverted hydrostatic standpipe 2 receives the pump chamber exhaust port during assembly.

6. Riser—The riser is a hollow tube, open on both ends and in fluid connection with the pump chamber 5 exhaust port on one end and in fluid communication with the atmosphere at its terminus. Riser diameter may vary according to the mixed medium being pumped but must be within parameters that include but are not limited to the preservation of the liquid and gas content separation (Archimedes' Principle=kinetic energy,) in the riser (See FIG. 3 & FIG. 4). Pump yield is a function of riser diameter and is not affected by elevation of delivery. First generation prototype ⅜" risers deliver 1 cup of liquid every 100 seconds. (54 gallons/day)

7. Primary Reservoir (ambient gas configuration only—See FIG. 4)—The primary reservoir is of sufficient elevation above the reservoir 1 to enable a siphon 8 from the primary reservoir to transport liquid from the primary reservoir and ambient pressure gas drawn through the venturi 9 to the pump chamber 5 in the reservoir 1. The preferred ambient gas configuration can be installed for permanent 24 hour a day operation (See 'Note:' in OPERATION).

8. Siphon (ambient gas configuration only—See FIG. 4)—The siphon is a hollow tube open on both ends and in fluid communication with the primary reservoir 7 on one end and in fluid communication with the pump chamber 5 and reservoir 1 at its terminus. By means of the low pressure generated (kinetic energy) in the siphon, ambient pressure gas is drawn into the siphon (gravitational potential energy) through the venturi 9 and delivered to the pump chamber 5. (See FIG. 4)

9. Venturi (ambient gas configuration only—See FIG. 4)—The venturi is a hollow tube open on both ends, in fluid connection with the adjustable valve 10 on one end and in fluid connection with the siphon 8 at an elevation above the primary reservoir 7 surface at its terminus.

10. Adjustable valve (ambient gas configuration only—See FIG. 4)—An adjustable valve is in fluid connection with the venturi 9 on one end and in fluid communication with the atmosphere at its terminus for regulating the amount of gas introduced into the siphon.

LIST OF DRAWINGS

Figure 2:
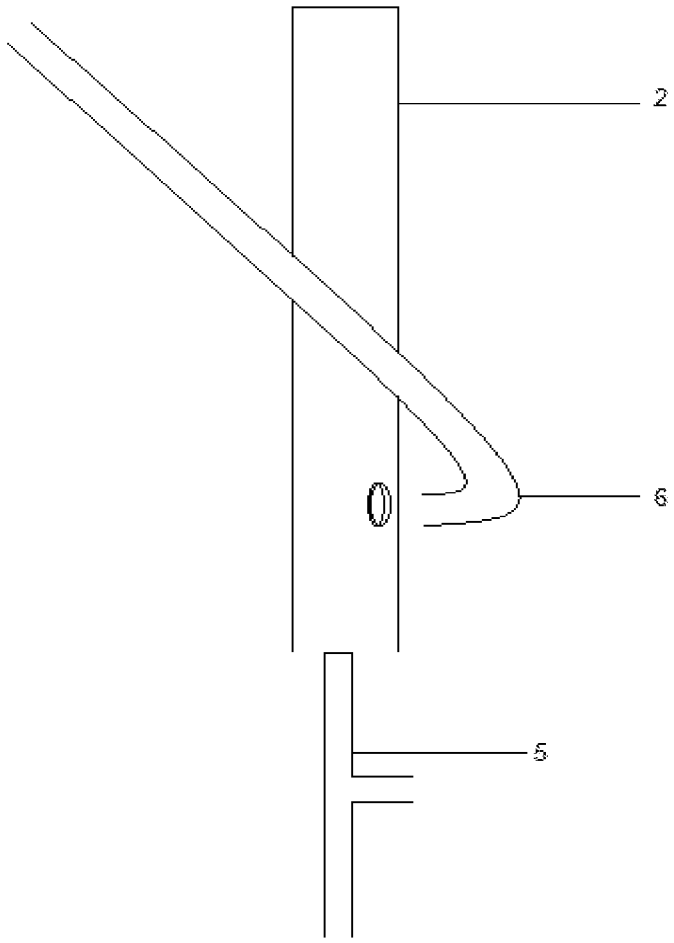
Figure 3:
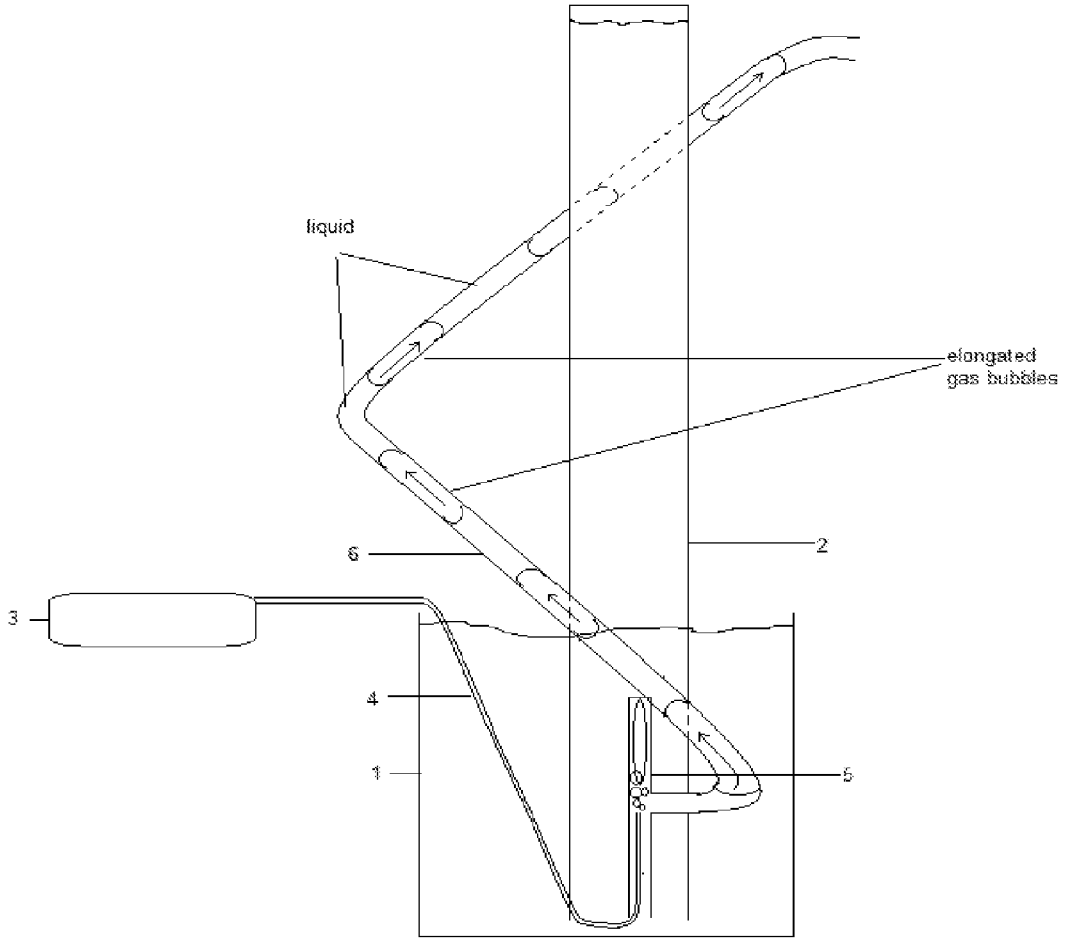
Figure 4:
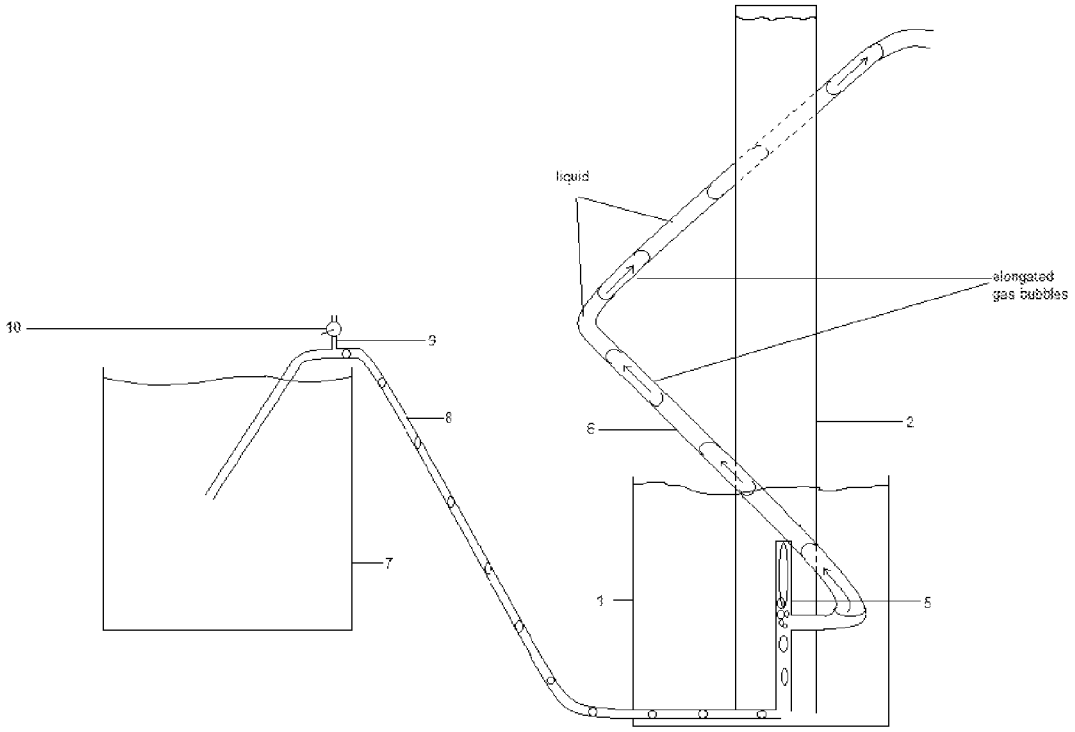

FIG. 1 The Subtle Energy Pump in situ—cross section
FIG. 2 The Subtle Energy Pump—exploded view
FIG. 3 Compressed gas configuration—cross section
FIG. 4 Ambient gas configuration—cross section

DETAILED DESCRIPTION OF THE PREFERRED EMBODIMENT OF THE PROCESS

A submerged pulsating gas displacement pump (See FIG. 1) with no moving parts, for transforming ambient pressure liquid and gas entering the pump via separate inlets from a liquid source upstream 1 or 7, and a gas source upstream 3 or 9 to a regulated intermittent pulsating flow evacuated downstream into a connected riser 6. Suspended in the riser 6, the gas and liquid are ready for transport at near-ambient pressure.

Enveloped by an inverted hydrostatic standpipe 2, this pulsating device is comprised of an exhausted chamber, (hereinafter referenced as 'the pump chamber 5'), for receiving the liquid and gas flows entering the device, that occupying an initial volume in the pump chamber 5, the liquid (hereinafter referenced as the 'liquid column') entering the pump chamber 5, is displaced by gas, increasing the volume that the gas occupies in the pump chamber 5 for the purpose of effecting a transient hydraulic surge in said liquid column for the purpose of exploiting a segment of said liquid column at the zenith of this transient hydraulic surge. The transient hydraulic surge is resultant of excess gas accumulation in the pump chamber 5 being released through the pump chamber 5 exhaust port and displacing liquid present in the riser 6 by means of increasing that liquid's elevation. The transient hydraulic surge occurs sequentially at or above in connected proximity to the pump chamber 5 exhaust port, completing the pump cycle as a portion of the liquid column is drawn by exhausting gas through the exhaust port and into the riser 6 where it is held in suspension by the expiration of the transient hydraulic surge and the resumption of atmospheric pressure to said liquid column. Once held in suspension in the riser 6, the gas and liquid are ready for transport. Each cycle's gas exhaust displaces the previous cycle's suspended liquid exhaust and the potential and kinetic energies of the inverted hydrostatic standpipe 2, atmospheric pressure on the reservoir 1, and gas buoyancy in the riser 6, propel the liquid and gas as a regulated intermittent pulse (See FIG. 3 & FIG. 4) over extended distances and inclined planes. The inverted hydrostatic standpipe 2 environ increases the pumps ability to do work, e.g. the higher the elevation desired for gas and liquid delivery, the taller the inverted hydrostatic standpipe 2 needed.

Operation

Operation is initiated by the introduction of gas and is suspended by interrupting the gas flow. Assembly and disassembly is quick and easy as all parts are a tolerance fit and require no fasteners.

This apparatus has been successfully tested to elevations of approximately 10 feet but atmospheric pressure at sea level will only support a water column approximately 33 feet tall, suggesting a possible elevation limit to this apparatus.

This process of energy derivation embodied by a maintenance-free apparatus moves liquid and gas 24 hours a day. Care should be taken to keep the bottom of the standpipe clear of debris that might clog the pump.

The route of the riser for a remote delivery should be one that provides a gradual incline and avoids sharp turns. For delivery closer to the pump assembly, the standpipe may be used to support the riser in a loosely coiled fashion that maintains a gradual upward slope to the delivery height.

Note: Permanent installation of this device might, depending upon the conditions present, require a periodic disassembly and cleaning of any growth that might prove detrimental to the pump cycle.

What is claimed:

1. A liquid delivery system, comprising:

a liquid reservoir containing liquid having an upper surface of the liquid at a reservoir liquid level within said reservoir, said upper surface of the liquid being exposed to atmospheric pressure;

an inverted hydrostatic standpipe containing liquid and sealed at a top end of the standpipe, the standpipe being in fluid communication with the liquid within the reservoir at a lower end of the standpipe and extending upwardly from said reservoir, the standpipe having an elevated liquid level within the standpipe that is above the reservoir liquid level of the reservoir;

a pump chamber located within said standpipe, the pump chamber being sealed at a top end of the pump chamber and being in fluid communication with the liquid within the standpipe and the liquid in the reservoir at a lower end of the pump chamber;

a gas supply having an inlet discharging into a lower end of the pump chamber for delivering gas into the pump chamber, and said pump chamber having a pump chamber exhaust port extending from the pump chamber at a height above said inlet and below the top end of the pump chamber;

a riser tube connecting to the pump chamber via the pump chamber exhaust port and extending upwardly to a discharge opening at a terminus of the riser tube in communication with the atmosphere, said riser being configured to transport gas and liquid suspended therein through the discharge opening of the riser;

whereby the gas delivered by the gas supply entering the pump chamber accumulates and displaces liquid within the pump chamber until excess gas is released through the pump chamber exhaust port into the riser and gas buoyancy in the riser and atmospheric pressure propels liquid in the riser upwardly and out through the discharge opening of the riser.

2. The system of claim 1, wherein said gas supply includes an ambient gas source or a compressed gas source that delivers gas bubbles through said inlet into the pump chamber.

3. The system of claim 2, wherein said gas supply includes a solar powered gas compressor.

4. The system of claim 1, wherein the liquid is water.

5. The system of claim 1, wherein the gas is air.

6. The system of claim 1, wherein said gas supply includes a gas supply tube that extends through the liquid within said reservoir to said inlet discharging into the lower end of the pump chamber for delivering gas into the pump chamber.

7. The system of claim 1, wherein said system is configured to initiate delivery of the liquid by introducing the gas by said gas supply.

8. The system of claim 1, wherein said system is configured to stop delivery of the liquid by interrupting delivery of the gas by said gas supply.

9. The system of claim 1, wherein the riser is gradually inclined and free from sharp turns so that gas bubbles freely flow therein.

10. The system of claim 1, wherein the riser has a diameter sized to maintain gas bubbles within the riser separated from the liquid within said riser.

11. The system of claim 10, wherein said riser has a diameter of about ⅜ inch.

12. The system of claim 1, wherein said system is configured such that the gas delivered by the gas supply entering the pump chamber cyclically accumulates and displaces liquid within the pump chamber until excess gas is released through the pump chamber exhaust port into the riser to cyclically create elongated gas bubbles that propel liquid upwardly through the riser.

13. A method of delivering liquid, comprising:

providing a liquid reservoir containing liquid having an upper surface of the liquid at a reservoir liquid level within said reservoir, said upper surface of the liquid being exposed to atmospheric pressure;

providing an inverted hydrostatic standpipe containing liquid and sealed at a top end of the standpipe, the standpipe being in fluid communication with the liquid within the reservoir at a lower end of the standpipe and extending upwardly from said reservoir, the standpipe having an elevated liquid level within the standpipe that is above the reservoir liquid level of the reservoir;

providing a pump chamber located within said standpipe, the pump chamber being sealed at a top end of the pump chamber and being in fluid communication with the liquid within the standpipe and the liquid in the reservoir at a lower end of the pump chamber;

providing a gas supply having an inlet discharging into a lower end of the pump chamber for delivering gas into the pump chamber, and said pump chamber having a pump chamber exhaust port extending from the pump chamber at a height above said inlet and below the top end of the pump chamber;

providing a riser tube connecting to the pump chamber via the pump chamber exhaust port and extending upwardly to a discharge opening at a terminus of the riser tube in communication with the atmosphere, said riser being configured to transport gas and liquid suspended therein through the discharge opening of the riser; and accumulating gas delivered by the gas supply within the pump chamber until excess gas is released through the pump chamber exhaust port into the riser and gas buoyancy in the riser and atmospheric pressure propels liquid in the riser upwardly and out through the discharge opening of the riser.

14. The method of claim 13, wherein said method further includes cyclically accumulating the gas delivered by the gas supply entering the pump chamber until excess gas is released through the pump chamber exhaust port into the riser so as to cyclically create elongated gas bubbles that propel liquid upwardly through the riser.

15. The method of claim 13, including providing the liquid as water.

16. The method of claim 13, including providing the gas as air.

17. The method of claim 13, further including providing the gas supply with a gas supply tube that extends through the liquid within said reservoir to said inlet discharging into the lower end of the pump chamber and delivers gas into the pump chamber.

18. The method of claim 13, further including initiating delivery of the liquid by introducing said gas by said gas supply.

19. The method of claim 13, further including stopping delivery of the liquid by interrupting delivery of said gas by said gas supply.

20. The method of claim 13, further including providing the riser with a diameter along its length that is sized to maintain gas bubbles within the riser separated from the liquid within said riser.

* * * * *